US005775974A

United States Patent [19]

Hulsebus

[11] Patent Number: 5,775,974

[45] Date of Patent: Jul. 7, 1998

[54] UNIVERSAL JAW ATTACHMENT FOR MICROFINISHING MACHINE

[75] Inventor: Jon L. Hulsebus, Grandville, Mich.

[73] Assignee: K-Line Industries, Inc., Holland, Mich.

[21] Appl. No.: 763,237

[22] Filed: Dec. 10, 1996

[51] Int. Cl.[6] ..... B24B 1/00

[52] U.S. Cl. ..... 451/28; 451/304; 451/49

[58] Field of Search ..... 451/5, 8, 25, 49, 451/304, 307, 317, 28

[56] References Cited

U.S. PATENT DOCUMENTS

| | | | |
|---|---|---|---|
| 4,419,845 | 12/1983 | Voigt et al. | 451/317 |
| 4,682,444 | 7/1987 | Judge et al. | 451/49 |
| 4,993,191 | 2/1991 | Judge et al. | 451/317 |
| 5,060,423 | 10/1991 | Klotz | 451/49 |
| 5,095,663 | 3/1992 | Judge et al. | 451/49 |
| 5,311,704 | 5/1994 | Barton, II et al. . | |
| 5,437,125 | 8/1995 | Barton, II . | |
| 5,531,631 | 7/1996 | Judge | 451/49 |

*Primary Examiner*—Timothy V. Eley
*Assistant Examiner*—Derris H. Banks
*Attorney, Agent, or Firm*—Price, Heneveld, Cooper, DeWitt & Litton

[57] ABSTRACT

A universal shoe assembly is disclosed for a microfinishing machine having a base and a pair of jaw arms mounted to the base. The universal shoe assembly includes a shoe for applying grinding pressure to a surface of a workpiece, universal mounting means for mounting the shoe to one of the jaw arms of the microfinishing machine, and securing means for releasably securing the mounting means to the jaw arm of the microfinishing machine. Also disclosed is a taper-correcting shoe assembly for a microfinishing machine including a mounting structure adapted for mounting to an arm of a microfinishing machine, a first shoe movably mounted to the mounting structure for applying variable grinding pressure to a first portion of a surface of a workpiece, a second shoe mounted to the mounting structure adjacent the first shoe for applying grinding pressure to a second portion of the surface of the workpiece, and manual extension means, responsive to manual movement, for extending the first shoe outward from the mounting structure in order to correct any taper of the surface of the workpiece.

30 Claims, 7 Drawing Sheets

UNIVERSAL JAW ATTACHMENT FOR MICROFINISHING MACHINE

BACKGROUND OF THE INVENTION

This invention relates to microfinishing machines and more particularly to a jaw shoe assembly for use in a microfinishing machine.

Microfinishing is a surface finishing process that is performed after more rough and medium grinding of the surface of a workpiece, such as a machine part or component. Microfinishing is typically performed using a machine that brings some form of abrasive material into contact with the workpiece while the workpiece is rotated. Examples of workpieces upon which microfinishing is typically performed include crankshafts and camshafts of internal combustion engines.

An example of one such microfinishing machine is disclosed in U.S. Pat. No. 5,437,125 and shown in FIG. 1. This microfinishing machine is particularly well-suited for smaller shops that rebuild engines because it is less complex and less costly than larger scale microfinishing machines used for original manufacture of such machine parts and components. As shown in FIG. 1, microfinishing machine assembly 12 includes a polishing tool 10 having top and bottom jaw arms 14 and 16 which are both pivotally connected to a polishing tool body 18. Jaw arms 14 and 16 have respective first ends 24 and 26 adapted to be pivotally connected to body 18 and second ends 28 and 30 which are constructed to accept abrasive material such as an abrasive-coated tape 34 that may be fastened to shoes 32 which are connected to second ends 28 and 30 of jaw arms 14 and 16. Shoes 32 are adapted to receive the bearing surfaces 20 of a workpiece such as camshaft 22.

Disposed between first ends 24 and 26 and second ends 28 and 30 of upper and lower jaw arms 14 and 16 are identical pairs of connecting members 36 and 38 which extend from respective jaw arms 14 and 16. Connecting members 36 and 38 have respective through bores, which accept pivot pins 44 and 46, respectively. Upper jaw arm 14 has a handle 52 for bringing upper jaw arm 14 and lower jaw arm 16 forward to a treatment position.

The first ends 24 and 26 of jaw arms 14 and 16 are pivotally connected to two pairs of metal links 66 and 68. The pairs of metal links 66 and 68 are identical and are disposed on opposite sides of the first ends 24 and 26 of the jaw arms. The pairs of metal links 66 and 68 are connected at their other end to a slide block 70 forming a push-type toggle mechanism. Slide block 70 is disposed within hollow track 72 defined within polishing tool body 18. Hollow track 72 is configured to allow sliding engagement between slide block 70 and track 72. Slide block 70 has a threaded hole for receiving and connecting to a tie rod 76. Tie rod 76 extends within a hollow chamber of a sleeve 80 which is attached at one end to hollow track 72.

The actuating end of tie rod 76 is positioned in a fluid motor such as either a regulated hydraulic or regulated pneumatic cylinder, generally indicated as 86 which is attached to the other end of sleeve 80. This regulated cylinder 86 is operated by a manual control, not shown, to extend an actuating piston 90 of regulated cylinder 86 to which the tie rod end is connected. As actuating piston 90 is reciprocated according to the manual operation of regulated cylinder 86, tie rod 76 is reciprocated moving slide block 70 within track 72. Tie rod 76 and regulated cylinder 86 act in conjunction with slide bock 70 as an actuating means for moving jaw arms 14 and 16 to embrace the surface on the workpiece to be finished. As slide block 70 moves laterally in a first direction toward the workpiece from a first starting position to a second end position, it forces the pairs of metal links 66 and 68 to move to a vertical position and thus force jaw arms 14 and 16 to pivot around pivot pins 44 and 46. This brings second ends 28 and 30 and shoes 32 connected thereto, to bring the abrasive material 34 to bear upon the workpiece surface 20. Movement of the slide block 70 in a second direction opposite the first direction, correspondingly opens jaw arms 14 and 16.

Compressive contact between the abrasive material 34 attached to shoes 32 on jaw arms 14 and 16 and the workpiece surface 20 as the workpiece is being rotated about its longitudinal access, creates the microfinishing action that finishes the surface of the workpiece. Polishing tool 10 is pivotally supported upon a base 98 of microfinishing machine assembly 12 by a spherical bearing 92 having an aperture 94 adapted to slidably receive sleeve 80. Spherical bearing 92 is journaled within housing 96 which is connected to base 98. Spherical bearing 92 and housing 96 act as a support means for pivotally supporting polishing tool 10 and allows for movement of the polishing tool. Specifically, the use of spherical bearing 92 and housing 96 allow for vertical, pivotal movement of polishing tool 10. Such vertical movement is desirable when microfinishing crankshaft pin surfaces. For adequate microfinishing of pin bearing surfaces, the entire polishing tool 10 is preferably movable with respect to the throw of the crankshaft pin bearings. This flexibility is desirable because the bearing surfaces of the pin bearings are positioned eccentrically with respect to the center of rotation of the crankshaft. Polishing tool 10 constructed as shown in FIG. 1 can pivot vertically corresponding to the orbit of most crankshafts. The pivotal connection between spherical bearing 92 and sleeve 80 allows for polishing tool 10 to orbit with conventional pin bearing surfaces located on most crankshafts.

Shoes 32 are permanently attached to jaw arms 14 and 16. Due to the pivotal assembly of jaw arms 14 and 16 to polishing tool 10, jaw arms 14 and 16 may not be rotated about their longitudinal axis in the event that the workpiece surface is undesirably tapered. An example of a tapered surface of a workpiece 114 is shown in FIG. 2. In general, a surface is considered to be "tapered" when its diameter varies along the longitudinal axis of the workpiece.

A microfinishing machine designed to correct taper in a workpiece surface is disclosed in U.S. Pat. No. 5,311,704 and is described below with reference to FIGS. 2–4. As shown in FIG. 3, this microfinishing machine includes an upper jaw arm 122 having a two-piece shoe assembly connected thereto, including a first shoe portion 118 and a second shoe portion 120 which are independently extendable in the direction of the workpiece surface. This microfinishing machine includes two sets of diametrically-opposed sensors 164 and 166, and 168 and 170, that are provided to detect whether a taper exists in a cylindrical workpiece surface. These sensors are connected to a processor 172 which in turn is connected to a comparator 174 that compares the difference and measured diameters to a threshold to determine whether a taper exists. If a taper exists, comparator 174 provides a control signal to a fluid compressor 154 for one of the respective shoe portions 118 and 120 to automatically extend that shoe portion toward the tapered work surface such that greater pressure is brought to bear on the abrading material 161 on that portion of the work surface where the diameter is greatest.

The implementation of such a shoe assembly is shown in more detail in FIG. 4. An upper jaw arm assembly 110 includes a relatively complex mounting structure 116 for permanently mounting shoe portions 118 and 120 to upper jaw arm 122 such that they will be independently and selectively extended through the operation of fluid compressor 154. First shoe portion 118 is affixed to upper jaw arm 122 by mounting members 138 and 140. Mounting members 138 and 140 have threaded portions 142 and 144 which fit into tapered mounting holes 146 and 148 within first shoe portion 118. Mounting members 138 and 140 are also positioned within jaw arm mounting holes 150 and 152. Positioning dowels 134 and 136 are permanently affixed to first shoe portion 118 and are positioned in slip-fit engagement to corresponding dowel pin holes within upper jaw arm 122. In this arrangement, first shoe portion 118 is affixed to upper jaw arm 122 and is capable of vertical movement subject to preestablished limits corresponding to mounting members 138 and 140.

Upper jaw arm 122 has an elongated bore 126 and a corresponding reciprocating piston 128. Reciprocating piston 128 is positioned inside elongated bore 126 such that a shoe-engaging portion 156 thereof is in direct contact with first shoe portion 118. O-rings 130 and 132 are disposed as shown in FIG. 4 for bore sealing purposes. Fluid inlet 124 is in direct fluid communication with elongated bore 126.

Abrasive inserts 158 may be used as an abrasive means for removing material from the bearing surface 114 of workpiece 112. Such abrasive inserts 158 may be affixed within first shoe portion 118 such that compressive contact of the abrasive inserts 158 with rotating bearing surface 114 removes material therefrom.

A lower jaw arm 121 is shown in phantom in FIG. 4 located below and opposite upper jaw arm 122. Lower jaw arm 121 includes an abrasive material for finishing bearing surface 114 as discussed above with respect to upper jaw arm 122. Shoe portions 118 and 120, including their mounting mechanisms discussed above, are identical and have surface configurations corresponding to the shape of the workpiece surface.

Fluid compressor 154 induces fluid, either air or liquid, into elongated bore 126 through fluid inlet 124. Thus, the variable pressure that can be induced by the fluid compressor reciprocates piston 128 vertically inside elongated bore 126. As pressure is applied from fluid compressor 154 through the bore into first shoe portion 118, first shoe portion 118 comes into contact with the abrading material for removing material on the workpiece surface.

As will be clear to those of ordinary skill in the art, the taper-correcting microfinishing machine described above is fairly complex. As apparent from the above discussion of the first microfinishing machine disclosed in U.S. Pat. No. 5,437,125 and the discussion of the taper-correcting second microfinishing machine disclosed in U.S. Pat. No. 5,311,704, if a shop already owned and utilized the first microfinishing machine and desired to have the ability to correct taper in a workpiece, the shop owner would be required to separately purchase the taper-correcting second microfinishing machine. Because such microfinishing machines may not be frequently used in such shops, the purchase of a second, more complex microfinishing machine is often too costly to justify.

In other situations, a shop may include a number of such microfinishing machines at various work stations. Because the need for performing taper correction at any one work station is infrequent but nonetheless exists, the expensive and complex taper-correcting second microfinishing machine described above would have to be purchased for each such work station if the machines are not conveniently clustered together.

SUMMARY OF THE INVENTION

It is therefore an aspect of the present invention to solve the above problems by providing a universal, interchangeable jaw shoe assembly for use on new and existing microfinishing machines. Another aspect of the present invention is to provide a mounting structure for jaw shoe assemblies that enables a user to readily remove and interchange shoe assemblies from a jaw arm of a microfinishing machine.

To accomplish these and other aspects of the present invention, the jaw assembly of the present invention comprises first and second jaw arms mounted to a base of a microfinishing machine wherein one of the jaw arms is movable relative to the other jaw arm for engaging a workpiece from opposite directions. The jaw assembly further includes a shoe for applying grinding pressure to a surface of a workpiece, universal mounting means adapted for mounting the shoe to the first jaw arm of the microfinishing machine, and securing means for releasably securing the mounting means to the first jaw arm. By providing such a universal mounting means, a taper-correcting shoe assembly constructed in accordance with the present invention may be readily interchanged with any other form of shoe assembly on a single microfinishing machine.

Yet another aspect of the present invention is to provide a taper-correcting shoe assembly that is easy to construct and use and low in manufacturing cost. Still another aspect of the present invention is to provide a taper-correcting shoe assembly that may be used with any conventional microfinishing machine without requiring any elaborate fluid passages in the jaw arm assemblies.

To achieve these and other aspects of the present invention, the taper-correcting shoe assembly of the present invention comprises a mounting structure adapted for mounting to an arm of a microfinishing machine, a first shoe movably mounted to the mounting structure for applying variable grinding pressure to a first portion of a surface of a workpiece, and a second shoe mounted to the mounting structure adjacent the first shoe for applying grinding pressure to a second portion of the surface of the workpiece. The taper-correcting shoe assembly further includes manual extension means, responsive to manual movement, for extending the first shoe outward from the arm on which the first shoe is mounted in order to correct any taper of the surface of the workpiece.

These and other features, advantages, and objects of the present invention will be further understood and appreciated by those skilled in the art by reference to the following specification, claims, and appended drawings.

BRIEF DESCRIPTION OF THE DRAWINGS

In the drawings:

FIG. 9 is a cross-sectional view of the taper-correcting shoe assembly of the present invention taken figline IX—IX in FIG. 6 as shown in an extended position;

DETAILED DESCRIPTION OF THE PREFERRED EMBODIMENT

Figure 1:
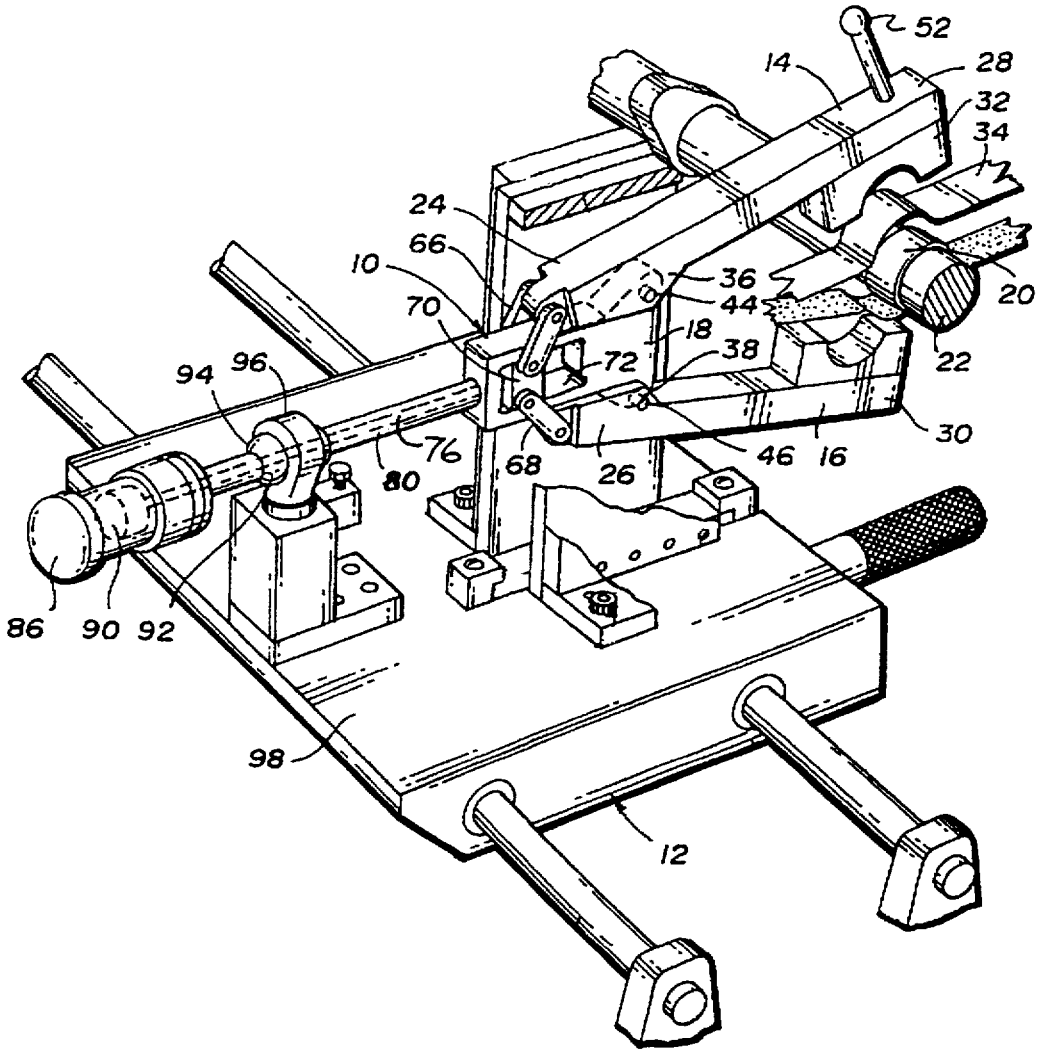
FIG. 1 is a perspective view of a conventional microfinishing machine with which the shoe assembly of the present invention may be used.

The taper-correcting shoe assembly of the present invention is shown in various forms in FIGS. 5–9B and is generally referenced by reference numeral 200. In the drawing figures, the components of taper-correcting shoe assembly 200 are referenced using the same reference numerals to enable those skilled in the art to more readily understand the nature and construction of the present invention.

Taper-correcting shoe assembly 200 may be used on any microfinishing machine, such as that shown in FIG. 1 and disclosed in U.S. Pat. No. 5,437,125, which has a pair of jaw arms fixed to a base for engaging a workpiece. The entire disclosure of U.S. Pat. No. 5,437,125 is incorporated herein by reference. Taper-correcting shoe assembly 200 preferably includes a mounting structure 210 adapted for mounting to a jaw arm of a microfinishing machine, a first shoe 220*a* movably mounted to mounting structure 210 for applying variable grinding pressure to a first portion of a surface of a workpiece and a second shoe 220*b* mounted to mounting structure 210 adjacent first shoe 220*a* for applying grinding pressure to a second portion of the surface of the workpiece. Shoes 220*a* and 220*b* are preferably formed of a hard rubber or other material that is conventionally used for shoes of a microfinishing machine. Additionally, taper-correcting shoe assembly 200 includes manual extension means that are responsive to manual movement for extending first shoe 220*a* outward from mounting structure 210 in order to correct any taper of the surface of the workpiece. A second manual extension means is also preferably included that is similarly responsive to manual movement for extending second shoe 220*b* outward from mounting structure 210 in order to correct taper.

The first and second manual extension means preferably include slidable levers 230*a* and 230*b* provided for each of respective shoes 220*a* and 220*b*. The slidable levers are provided between mounting structure 210 and a respective one of shoes 220*a* and 220*b*. As will be described in more detail below, slidable levers 230*a* and 230*b* serve as a translational structure for translating a lateral movement of slidable levers 230*a* and 230*b* to an extending movement of a respective shoe 220*a* and 220*b*.

Figure 8:
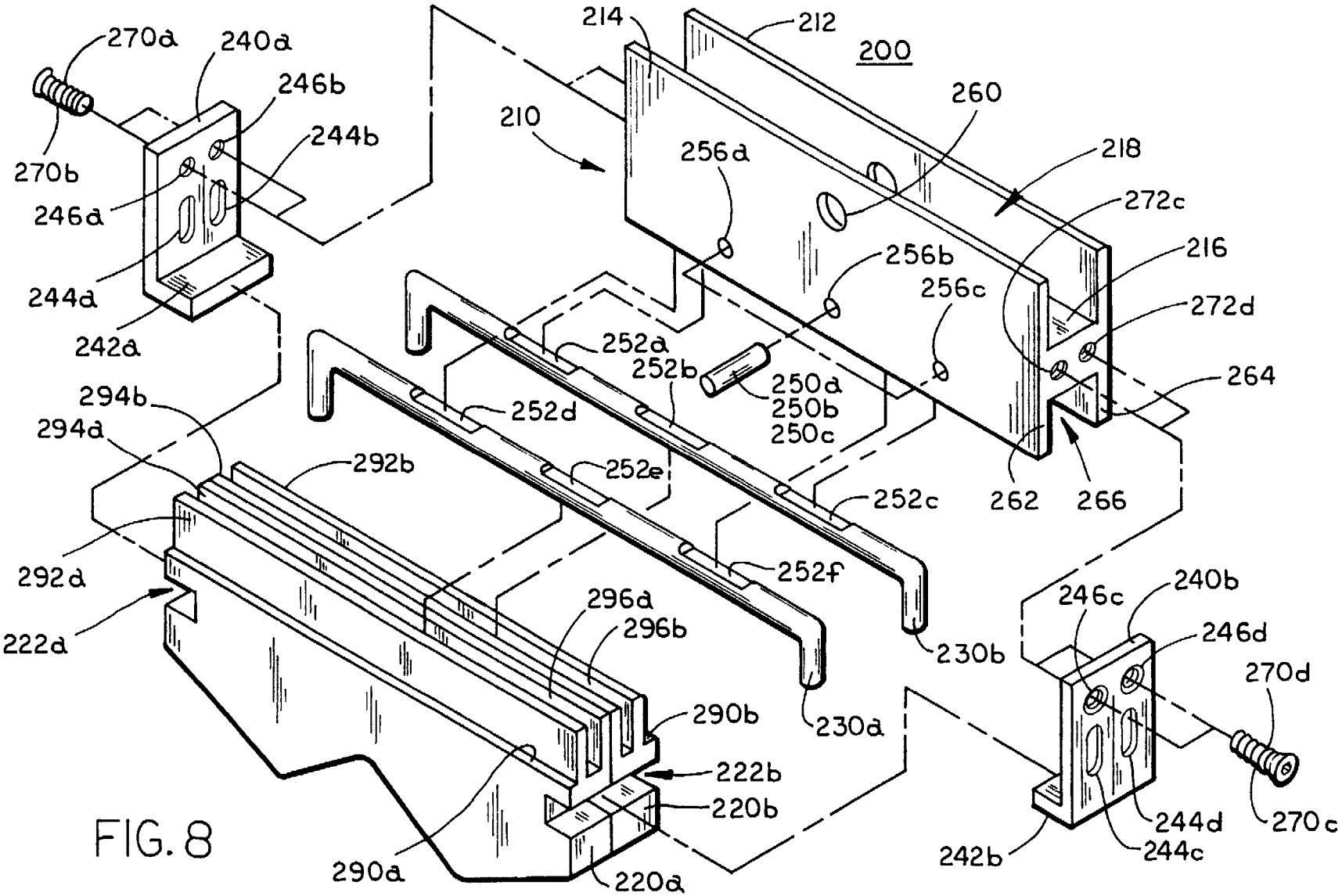
FIG. 8 is an exploded perspective view of the taper-correcting shoe assembly constructed in accordance with the present invention.

Mounting structure 210 is preferably a metallic die-cast structure having a general "H"-shape in cross section. Mounting structure 210 includes first and second upper side walls 212 and 214 that extend vertically upward and parallel along the length of the shoe assembly. Together with a bottom surface 216, upper side walls 212 and 214 form a "U"-shaped upper channel 218 for receiving a portion of a jaw arm. Mounting structure 210 also preferably includes first and second lower side walls 262 and 264, which extend in a downward vertical direction from upper side walls 212 and 214 to form a lower channel 266 that is provided for frictionally engaging an upper portion of shoes 220*a* and 220*b* as well as the manual extension means. As shown in FIG. 8, shoes 220*a* and 220*b* include elongated notches 290*a* and 290*b*, respectively, configured so as to matingly receive lower side walls 262 and 264, respectively, of mounting structure 210 such that the corresponding side surfaces of shoes 220*a* and 220*b* are flush with the side surfaces of mounting structure 210. By fitting these lower side walls 262 and 264 of mounting structure 210 within notches 290*a* and 290*b*, mounting structure 210 holds shoes 220*a* and 220*b* side-by-side while allowing shoes 220*a* and 220*b* to be extended vertically and, at the same time, preventing these shoes from moving in a direction perpendicular to the flush side surfaces of mounting structure 210 and shoes 220*a* and 220*b*.

Shoes 220*a* and 220*b* are both provided with elongated interior slots 296*a* and 296*b*, respectively, along a top surface of shoes 220*a* and 220*b*. Elongated slot 296*a* is defined by two parallel vertical, upwardly-extending ridges 292*a* and 294*a*. Similarly, elongated slot 296*b* is defined by upwardly-extending ridges 292*b* and 294*b*. The outward-facing surfaces of ridges 292*a* and 292*b* abut the inner surfaces of lower side walls 262 and 264 of mounting structure 210 while the inner surfaces of ridges 292*a* and 292*b* define slots 296*a* and 296*b* which respectively are configured to receive slidable levers 230*a* and 230*b*. The innerfacing surfaces of ridges 294*a* and 294*b* abut one another and provide isolation and spacing between slidable levers 230*a* and 230*b*.

Figure 9A:
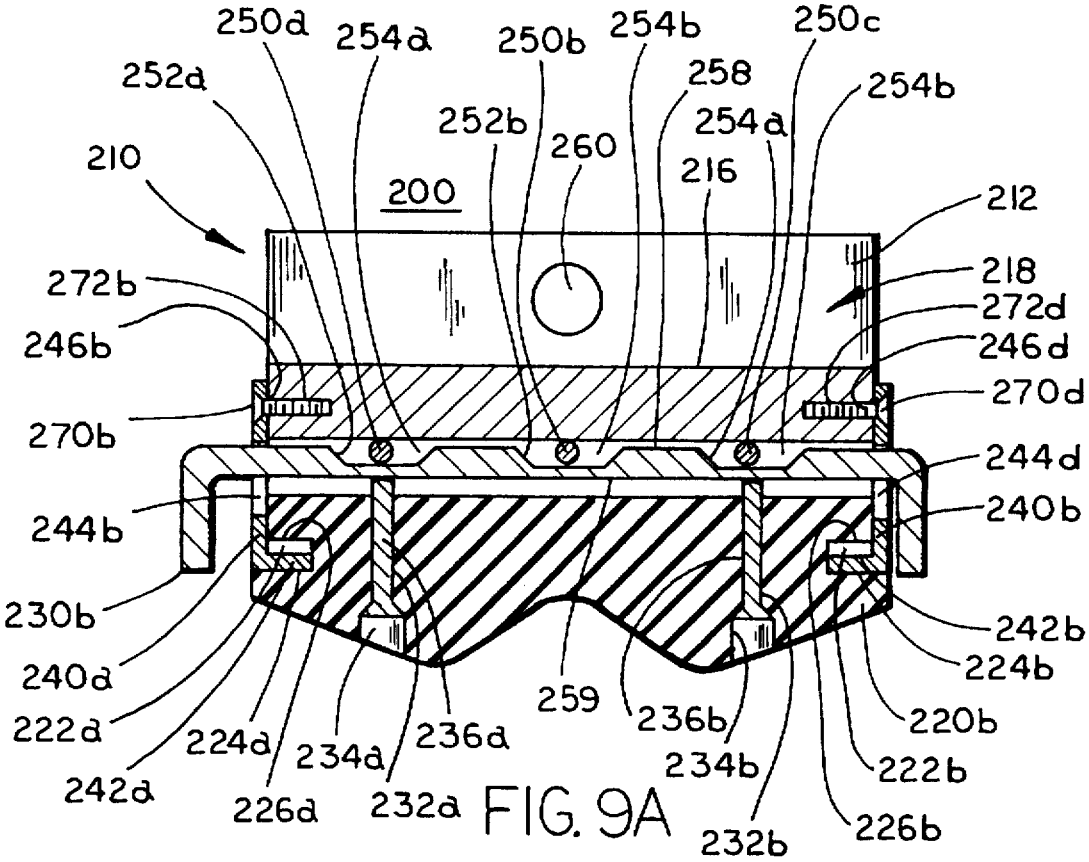
FIG. 9 is a cross-sectional view of the taper-correcting shoe assembly of the present invention taken line IX—IX in FIG. 6 as shown in a non-extended position.
Figure 9B:
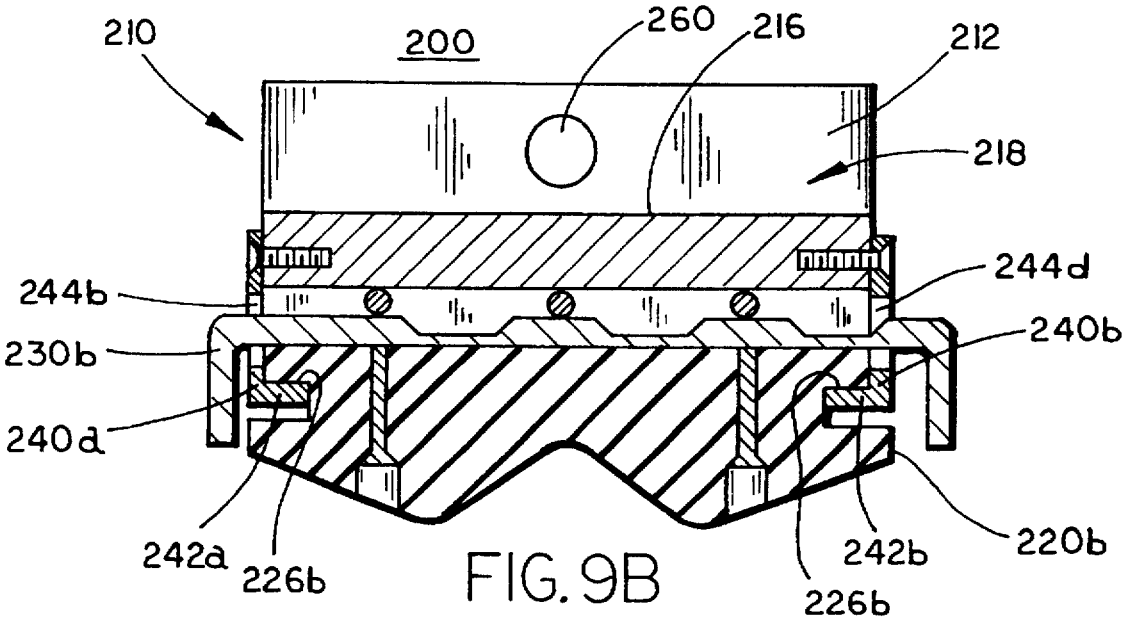

Taper-correcting shoe assembly 200 also preferably includes two guide plates 240*a* and 240*b*, which may be fixedly secured to respective ends of mounting structure 210. As shown in FIG. 8, guide plates 240*a* and 240*b* are fixed to ends of mounting structure 210 by means of a pair of bolts or screws 270*a* and 270*b*, and 270*c* and 270*d*, respectively, that are passed through holes 246*a*, 246*b*, 246*c*, and 246*d* formed in respective guide plates 240*a* and 240*b* so as to terminate in threaded bores 272*a*, 272*b*, 272*c*, and 272*d*, respectively, formed in the ends of mounting structure 210. Guide plates 240*a* and 240*b* are each formed with a pair of elliptical-shaped apertures 244*a*, 244*b*, 244*c*, and 244*d*, respectively, for alignment with elongated slots 296*a* and 296*b* formed in shoes 220*a* and 220*b*. Apertures 244*a*–244*d* are formed of sufficient width to receive an end of one of slidable levers 230*a* and 230*b* and have a vertical length sufficient to allow vertical movement of slidable levers 230*a* and 230*b*. Additionally, guide plates 240*a* and 240*b* are formed with respective ledges 242*a* and 242*b* that extend perpendicularly and inwardly from a lower end of the guide plates. Such ledges may be formed by bending the lower portion of the guide plates so as to provide a general "L"-shaped cross section. As shown in FIGS. 9A and 9B, ledges 242*a* and 242*b* extend into end recesses 222*a* and 222*b* formed along the end portions of shoes 220*a* and 220*b* in a direction perpendicular to the side surfaces thereof. End recesses 220*a* and 220*b* are respectively defined by upper edges 226a and 226b and lower edges 224a and 224b. Upper and lower edges forming end recesses 222a and 222b are spaced apart a sufficient distance to allow vertical extension of shoes 220a and 220b. By securing guide plates 240a and 240b to ends of mounting structure 210 and providing ledges 242a and 242b extending into end recesses 222a and 222b, shoes 220a and 220b may be prevented from being over-extended so as to become disengaged from lower channel 266 formed in mounting structure 210 while nevertheless allowing for vertical extension of the shoes.

Slidable levers 230a and 230b are preferably formed of metal and are identical in construction. As shown in FIGS. 9A and 9B, slidable lever 230b includes a first surface 258 for engaging mounting structure 210 and an opposite second surface 259 for slidably engaging and pushing outward shoe 220b. Mounting structure 210 preferably includes at least one and preferably three pins 250a, 250b, and 250c, which are inserted through holes 256a, 256b, and 256c, respectively, formed in lower side walls 262 and 264 of mounting structure 210. Pins 250a–250c are preferably provided in parallel spaced locations along the upper surface of lower channel 266 formed in mounting structure 210. Pins 250a–250c may be expanded at either end after passing through the holes in both of lower side walls 262 and 264. Alternatively, pins 250a–250c may be provided as bolts with one end being threaded to be secured in a threaded one of holes 256a–256c and having a screw head at the other end. As yet another alternative, pins 250a–250b could be replaced with rounded ridges that may be die-cast in parallel spaced relation along the upper surface of lower channel 266 as an integral part of mounting structure 210.

Figure 7:
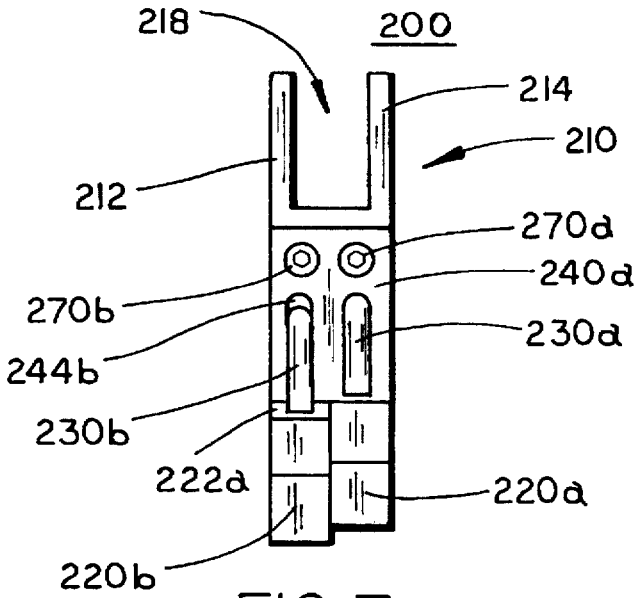
FIG. 7 is a side view of the taper-correcting shoe assembly constructed in accordance with the present invention.

Slidable lever 230b preferably has three ramped notches 254a–254c formed in its mounting-structure-engaging first surface 258 in locations spaced the same distance at which pins 250a–250c are provided in mounting structure 210. As shown in FIG. 9A, when slidable lever 230b is positioned such that notches 254a–254c correspond to the positions of pins 250a–250c, shoe 220b is in a non-extended position. As slidable lever 230b is slid laterally within slot 290b, first surface 258 slides past pins 250a–250c *l*until pins 250a–250c are no longer aligned with notches 254a–254c. Thus, slidable lever 230b is positioned relative to pins 250a–250c as shown in FIG. 9B. By providing notches 254a–254c with ramped edges 252a–252c, slidable lever 230b may be readily slid past pins 250a–250c from the notched portions to the raised portions of first surface 258. When slidable lever 230b is slid into the position shown in FIG. 9B, its shoe-engaging second surface 259 pushes shoe 220b *l*outward from mounting structure 210. Because separate slidable levers 230a and 230b *l*are provided for respective shoes 220a and 220b within isolated slots 296a and 296b, each shoe may be extended independently from the other as shown in FIG. 7.

Slidable levers 230a and 230b are preferably bent downward at both ends so as to place constraints on the distance for which the slidable levers may be slid within shoe assembly 200. Further, the bent end portions of slidable levers 230a and 230b provide a structure that may be more readily manually manipulated by an operator of the microfinishing machine.

Taper-correcting shoe assembly 200 also preferably includes a pair of adjusting screws 236a and 236b for each of shoes 220a and 220b. Adjusting screws 236a and 236b are respectively provided in threaded bores 232a and 232b formed in each shoe. Threaded bores 232a and 232b are preferably formed with a countersink 234a and 234b, respectively, such that the heads of adjusting screws 236a and 236b are well below the surface of the shoes. By turning adjusting screws 236a and 236b, the threaded end thereof pushes against the shoe-engaging second surface 259 of the corresponding slidable lever 230 and consequently pushes the shoe away from the shoe-engaging second surface 259 by a corresponding distance. In this manner, the amount of extension provided by moving one of slidable levers 230a and 230b may be adjusted by turning corresponding adjusting screws 236a and 236b *l*for that shoe.

Figures 2, 3:
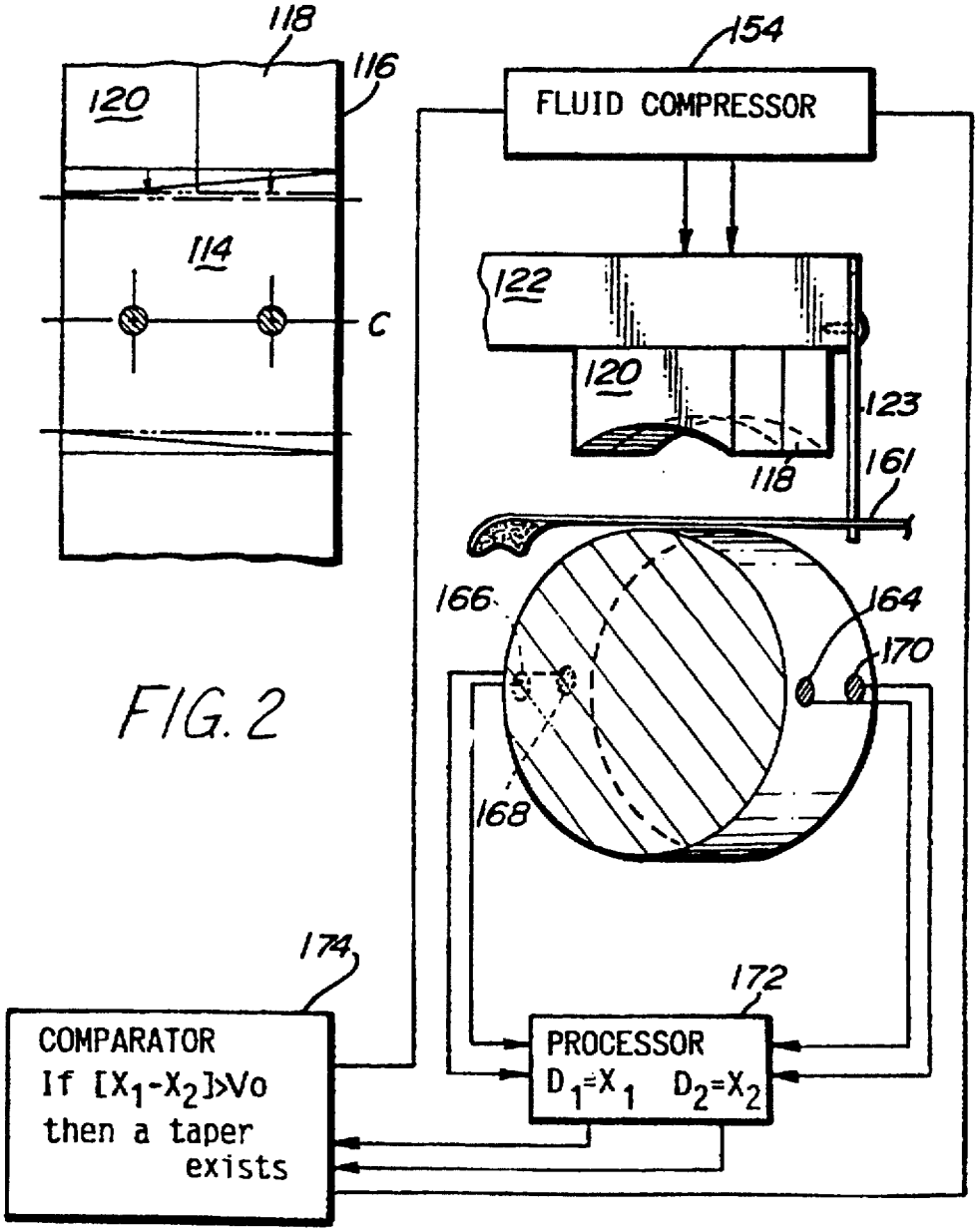
FIG. 2 is a partial front view showing shoe assemblies contacting a tapered surface of a workpiece.
FIG. 3 is a schematic view of a control system for a conventional taper-correcting microfinishing machine.
Figure 4:
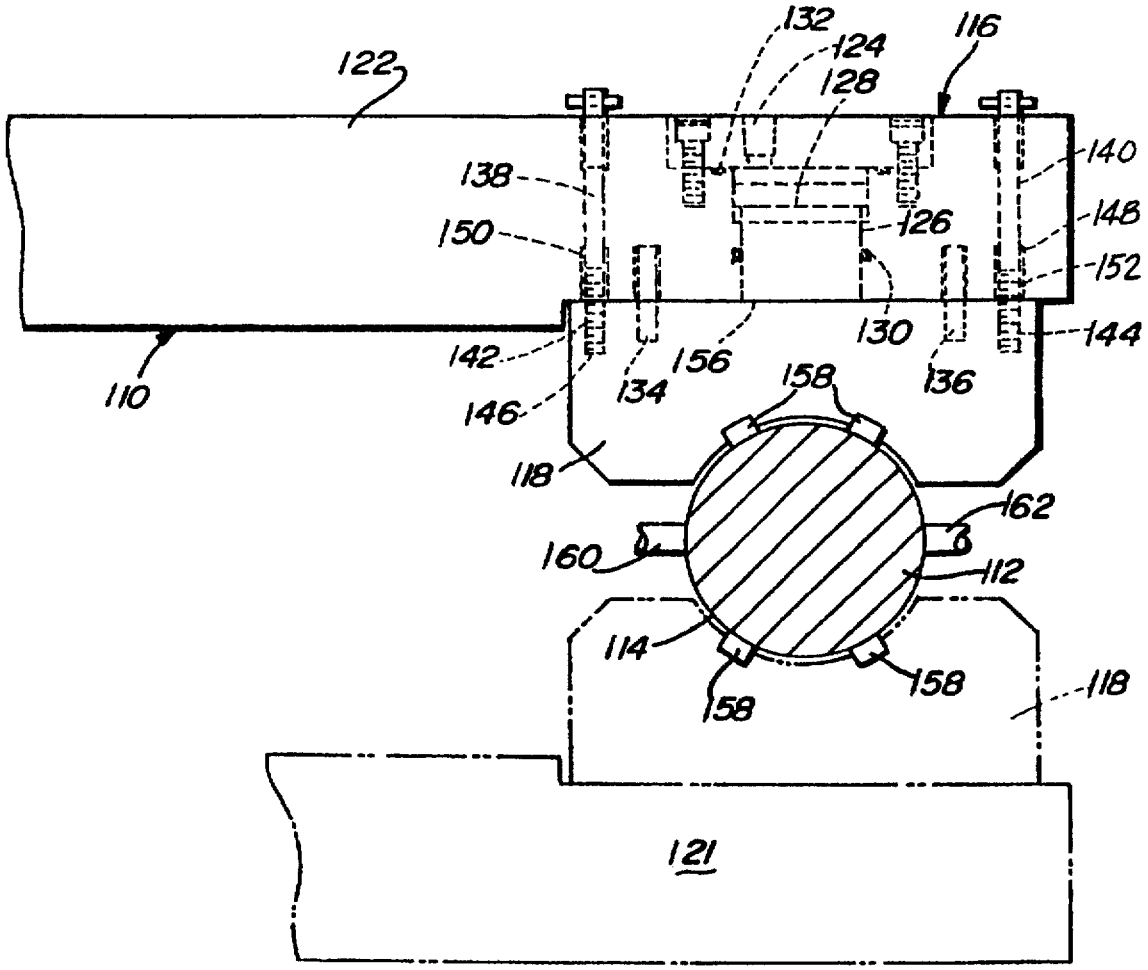
FIG. 4 is a side view of a taper-correcting microfinishing jaw arm assembly of a conventional microfinishing machine.
Figure 6:
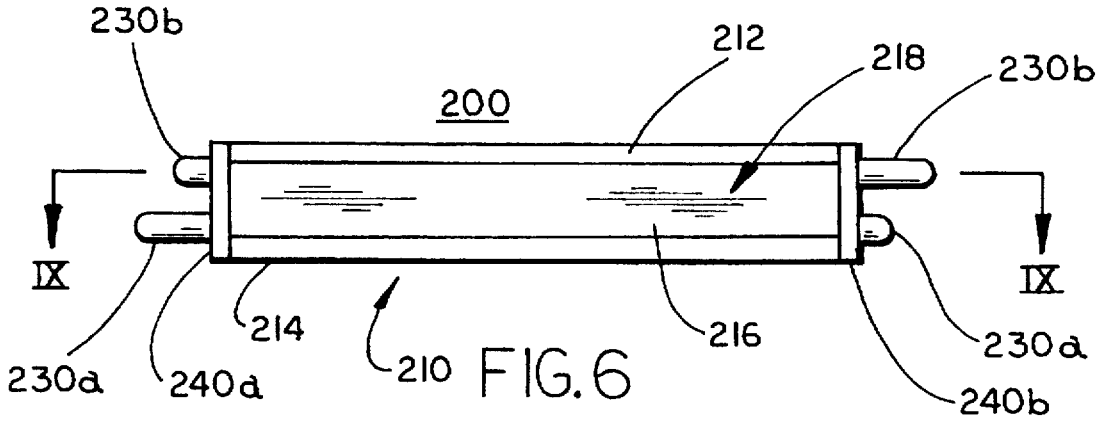
FIG. 6 is a top view of the taper-correcting shoe assembly constructed in accordance with the present invention.
Figure 5:
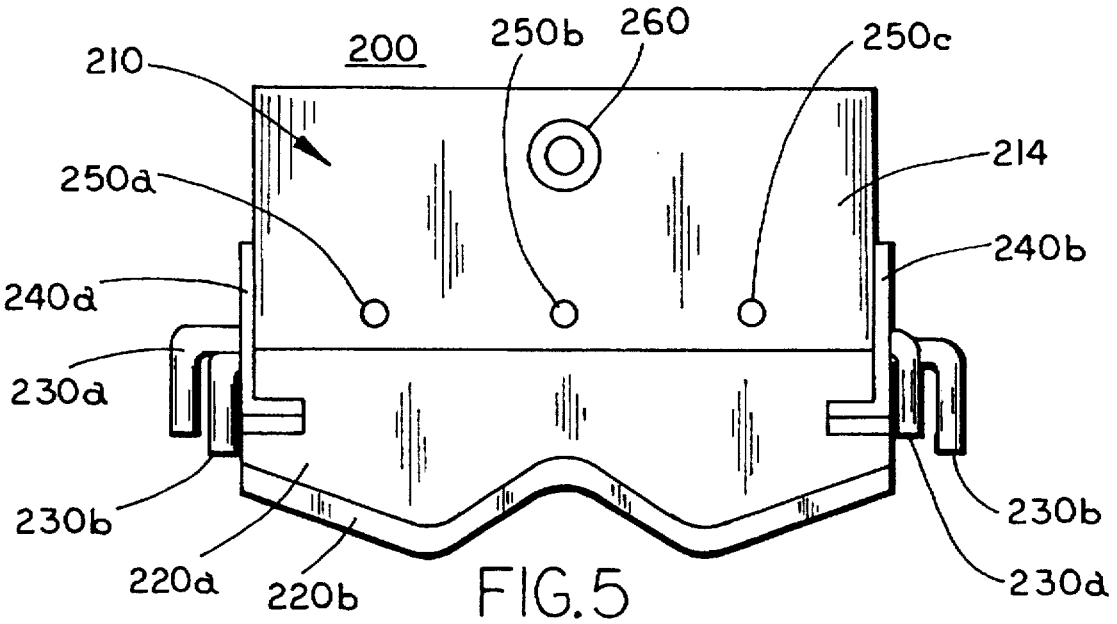
FIG. 5 is a front view of a taper-correcting shoe assembly constructed in accordance with the present invention.

As will be apparent to those skilled in the art, the above-described taper-correcting shoe assembly is relatively low in cost and may be readily assembled as compared to the conventional taper-correcting assembly described above and shown in FIGS. 3 and 4. Through experience working with the more complex taper-correcting microfinishing machine, it was discovered that the automated taper sensing and correcting performed by this microfinishing machine does not provide significantly greater precision than could be obtained by manual sensing and correction using the taper-correcting shoe assembly of the present invention. By eliminating the automated features of the taper-correcting shoe assembly shown in FIGS. 3 and 4, not only is the cost and complexity of the assembly reduced, but also, a taper-correcting shoe assembly can be provided for implementation with existing microfinishing machines that do not have or require the fluid passages provided in the jaw arm of such specialized microfinishing machines.

Figure 10A:
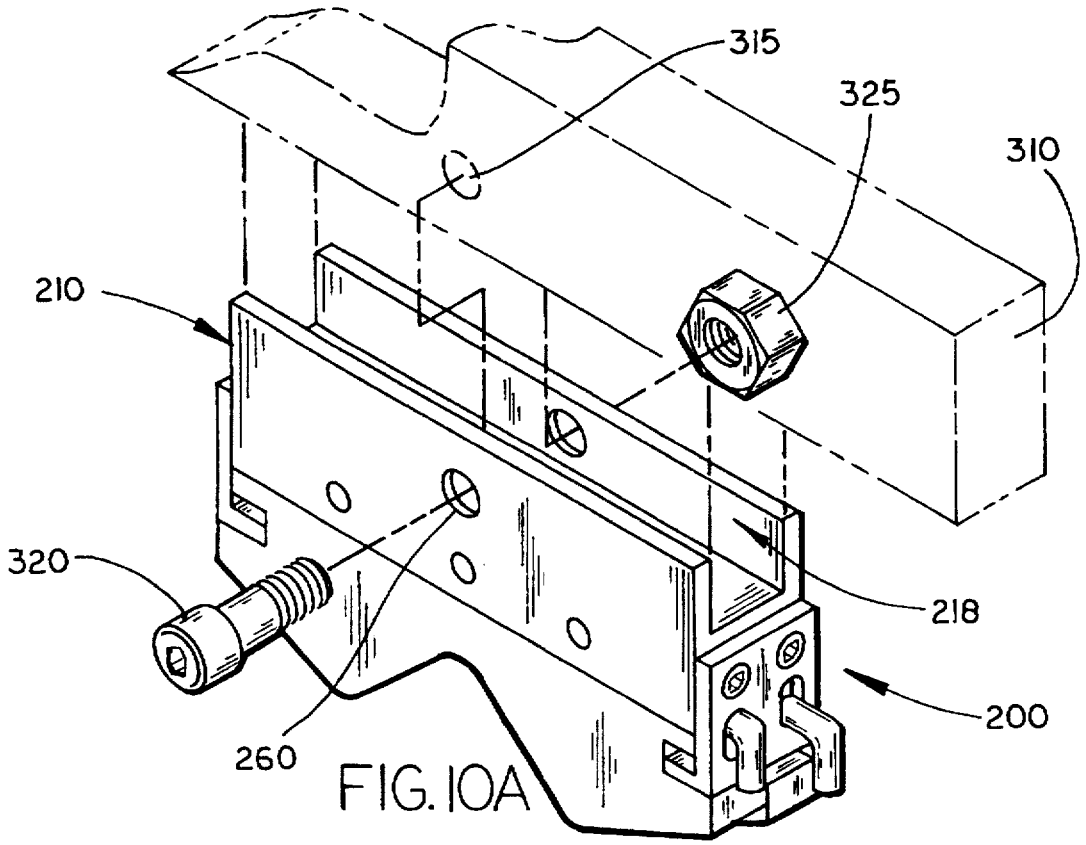
FIG. 10A is a partial exploded perspective view illustrating the mounting structure for the taper-correct&oe assembly constructed in accordance with the present invention.

As shown in FIG. 10A, mounting structure 210 is preferably formed with a bore 260 passing through upper side walls 212 and 214 and upper channel 218 for receiving a securing member 320, such as a bolt therethrough. By providing a similar bore 315 laterally through a jaw arm 310 of a microfinishing machine and by straddling shoe assembly 200 about jaw arm 310 such that jaw arm 310 lies within upper channel 218 with bore 315 in alignment with bore 260, bolt 320 may be passed through bores 260 and 315 and secured at the other end by a nut 325. In this manner, taper-correcting shoe assembly 200 may be used with any existing microfinishing machine by providing bore hole 315 laterally through at least one of its jaw arms 310. It will be appreciated by those skilled in the art that mounting structure 210 may be formed with any shape or size of upper channel 218 that is required to straddle a jaw arm of the microfinishing machine in which it is to be used.

Figure 10B:
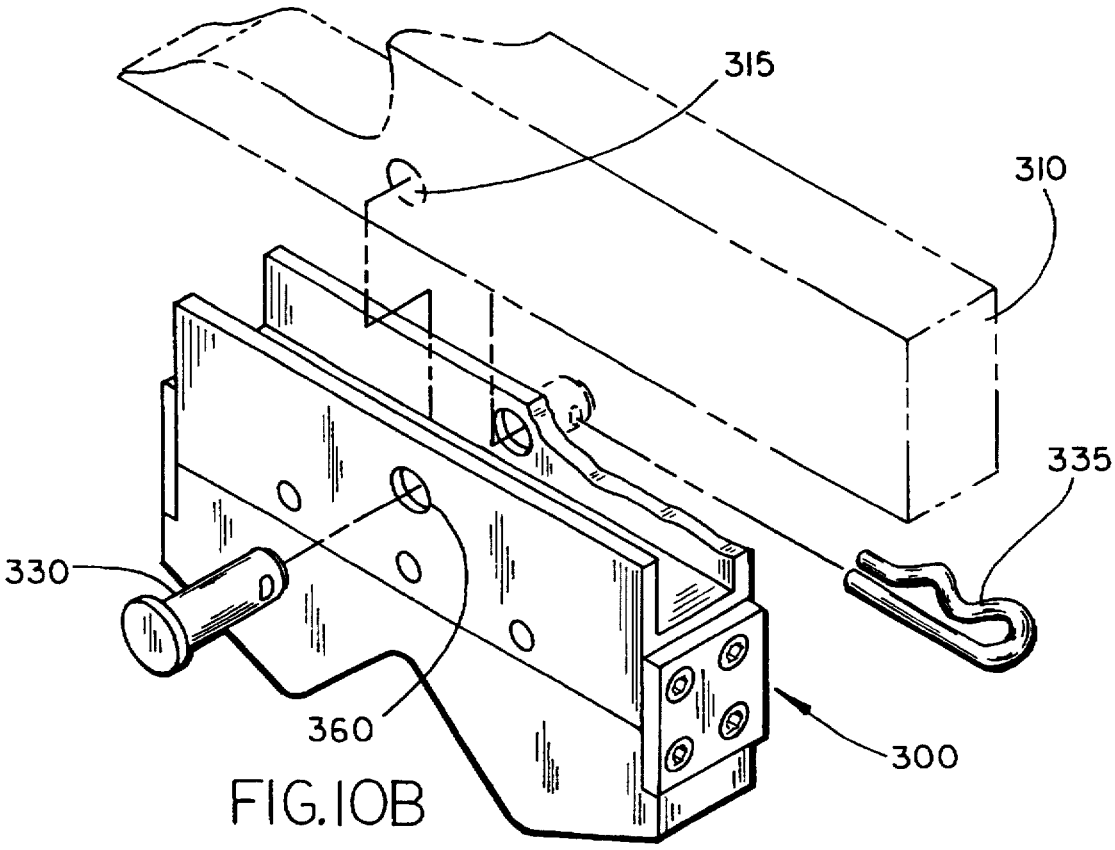
FIG. 10B is a partial exploded perspective view illustrating an alternative embodiment of the mounting structure for mounting a shoe assembly to a jaw arm of a microfinishing machine.

By providing all shoe assemblies to be used on any particular microfinishing machine, with an identical or substantially similar mounting structure, different types of shoe assemblies (i.e., taper-correcting shoe assemblies) may be readily interchanged on the jaw arm of a single microfinishing machine. As shown in FIG. 10B, a different form of shoe assembly 300, such as one that does not provide taper correction, is provided with a similar mounting structure as the shoe assembly 200 shown in FIG. 10A so that it may be interchanged with shoe assembly 200 on the same jaw arm 310 in the same manner described above. Also shown in FIG. 10B is an alternative embodiment for the securing means used to secure shoe assembly 200 or 300 to jaw arm 310. This alternative embodiment includes a pin 330 having a hole formed in one end for receiving a hood pin 335. Although only two embodiments for the securing means are shown, it will be appreciated by those skilled in the art that other securing mechanisms may be used. For example, more than one bore hole and securing bolt or pin may be used to secure mounting structure 210 to jaw arm 310. Further, mounting structure 210 could be modified such that upper side walls 212 and 214 extend above jaw arm 310 with one or more bore holes provided in the portion extending above jaw arm 315 for receiving securing bolts in such a manner that a bore hole through jaw arm 310 need not be provided.

Further, although the manual extension means has been described above as having a particular structure including slidable levers, other structural arrangements may be utilized provided such structures have the capability of maintaining the extended position of the shoes while the shoes are pressed against the surface of a workpiece.

It should be understood that taper-correcting shoe assembly 200 may be used on the upper jaw arm and/or the lower jaw arm, in which case the references to upper and lower components would be reversed.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the Doctrine of Equivalents.

The embodiments of the invention in which an exclusive property or privilege is claimed are defined as follows:

1. A taper-correcting shoe assembly for a microfinishing machine having a pair of arms fixed to a base for engaging a workpiece, said taper-correcting shoe assembly comprising:

a mounting structure adapted for mounting to an arm of a microfinishing machine;

a first shoe movably mounted to said mounting structure for applying variable grinding pressure to a first portion of a surface of a workpiece;

a second shoe mounted to said mounting structure adjacent said first shoe for applying grinding pressure to a second portion of the surface of the workpiece; and manual extension means, responsive to manual movement, for extending said first shoe outward from the arm on which said first shoe is mounted in order to correct any taper of the surface of the workpiece.

2. The taper-correcting shoe assembly as defined in claim 1 and further including locking means for locking said first shoe in a selected position relative to said mounting structure.

3. The taper-correcting shoe assembly as defined in claim 1, wherein said second shoe is movably mounted to said mounting structure for applying variable grinding pressure to the second portion of the surface of the workpiece, and wherein said manual extension means, responsive to manual movement, extends said second shoe outward from the arm on which said second shoe is mounted in order to correct any taper of the surface of the workpiece.

4. The taper-correcting shoe assembly as defined in claim 1, wherein said manual extension means includes a slidable lever positioned between said first shoe and said mounting structure.

5. The taper-correcting shoe assembly as defined in claim 4, wherein first shoe includes a slot formed along a surface thereof that is adjacent said mounting structure, and wherein said slidable lever is disposed within said slot.

6. The taper-correcting shoe assembly as defined in claim 4 and further including locking means for locking said slidable lever in a selected position so as to lock said first shoe in a selected position relative to said mounting structure.

7. The taper-correcting shoe assembly as defined in claim 4 and further including first and second guide plates mounted to opposite ends of said mounting structure, said guide plates having opposed apertures for receiving said slidable lever and guiding said slidable lever between said mounting structure and said first shoe.

8. The taper-correcting shoe assembly as defined in claim 7, wherein said first shoe includes first and second recesses formed in respective ends of said first shoe and wherein said guide plates each include a tongue extension projecting into a respective recess in said first shoe for limiting the distance that said first shoe may be extended from said mounting structure.

9. The taper-correcting shoe assembly as defined in claim 4 and further including translational means positioned between said slidable lever and said mounting structure for translating manual, lateral sliding movement of said slidable lever into extension movement of said first shoe relative to said mounting structure.

10. The taper-correcting shoe assembly as defined in claim 9, wherein said translational means includes at least one ramped recess formed in a bottom surface of said slidable lever and a bearing positioned between the bottom surface of said slidable lever and said mounting structure, wherein, when said slidable lever is in a first position, said ramped recess is positioned over said bearing such that said first shoe is in a non-extended position relative to said mounting structure, and when said slidable lever is in a second position, a portion of the bottom surface of said slidable lever other than said ramped recess is positioned over said bearing such that said slidable lever pushes said first shoe outward into an extended position relative to said mounting structure.

11. A taper-correcting shoe assembly for a microfinishing machine having a pair of arms fixed to a base for engaging a workpiece, said taper-correcting shoe assembly comprising:

a mounting structure adapted for mounting to an arm of a microfinishing machine;

a first shoe movably mounted to said mounting structure for applying variable grinding pressure to a first portion of a surface of a workpiece;

a second shoe movably mounted to said mounting structure adjacent said first shoe for applying variable grinding pressure to a second portion of the surface of the workpiece;

first manual extension means, responsive to manual movement, for extending said first shoe outward from the arm on which said first shoe is mounted in order to correct any taper of the surface of the workpiece; and second manual extension means, responsive to manual movement, for extending said second shoe outward from the arm on which said second shoe is mounted in order to correct any taper of the surface of the workpiece.

12. The taper-correcting shoe assembly as defined in claim 11, wherein said first and second manual extension means each includes a slidable lever positioned between said mounting structure and respective surfaces of said first and second shoes.

13. A jaw assembly for a microfinishing machine comprising:

first and second jaw arms mounted to a base of the microfinishing machine, one of said jaw arms being movable relative to the other jaw arm for engaging a workpiece from opposite directions;

a first shoe for applying grinding pressure to a surface of a workpiece;

a second shoe having a different grinding surface profile than said first shoe for applying grinding pressure to a surface of a workpiece in a different manner than said first shoe; and universal mounting means adapted for releasably and interchangeably mounting one of said first and second shoes to said first jaw arm of the microfinishing machine.

14. The jaw assembly as defined in claim 13, wherein said securing means includes a cylindrical member and said first jaw arm includes at least one bore and said mounting means includes at least one bore for alignment with the bore of said first jaw arm for receiving said cylindrical member.

15. The jaw assembly as defined in claim 14, wherein the bore of said first jaw arm is threaded and said cylindrical member is a bolt.

16. The jaw assembly as defined in claim 13, wherein said second shoe assembly is a taper-correcting shoe.

17. A jaw assembly for a microfinishing machine comprising:

first and second jaw arms mounted to a base of the microfinishing machine, one of said jaw arms being movable relative to the other jaw arm for engaging a workpiece from opposite directions;

a shoe for applying grinding pressure to a surface of a workpiece;

universal mounting means adapted for mounting said shoe to said first jaw arm of the microfinishing machine; and securing means for releasably securing said mounting means to said first jaw arm, wherein said shoe is a taper-correcting shoe including a first shoe portion movably mounted to said mounting means for applying variable grinding pressure to a first portion of the surface of the workpiece, and a second shoe portion mounted to said mounting means adjacent said first shoe portion for applying grinding pressure to a second portion of the surface of the workpiece.

18. The jaw assembly as defined in claim 17, and further including manual extension means, responsive to manual movement, for extending said first shoe portion outward from said first jaw arm in order to correct any taper of the surface of the workpiece.

19. A jaw assembly for a microfinishing machine comprising:

first and second jaw arms mounted to a base of the microfinishing machine, one of said jaw arms being movable relative to the other jaw arm for engaging a workpiece from opposite directions;

a shoe for applying grinding pressure to a surface of a workpiece;

universal mounting means adapted for mounting said shoe to said first jaw arm of the microfinishing machine, wherein said mounting means is generally U-shaped with a bottom and two sides defining a channel for receiving said first jaw arm; and securing means for releasably securing said mounting means to said first jaw arm, wherein said first jaw arm includes at least one bore and at least one of said two sides of said mounting means includes at least one bore for alignment with the bore of said first jaw arm for receiving said securing means.

20. The jaw assembly as defined in claim 19, wherein both of said two sides of said mounting means have a bore formed therein in opposition to each other for alignment with the bore of said first jaw arm for receiving said securing means therethrough.

21. The jaw assembly as defined in claim 20, wherein said securing means includes a hood pin and a cylindrical shaft for insertion through the bores of said mounting means and said first jaw arm, said cylindrical shaft having a head on one end and an aperture formed in an opposite end for receiving said hood pin.

22. The jaw assembly as defined in claim 20, wherein said securing means includes a bolt for insertion through the bores of said mounting means and said first jaw arm.

23. The jaw assembly as defined in claim 22, wherein said securing means further includes a nut for securing said bolt within the bores of said mounting means and said first jaw arm.

24. The jaw assembly as defined in claim 22, wherein one of the bores of said mounting means and said first jaw arm is threaded for securing said bolt within the bores of said mounting means and said first jaw arm.

25. A universal shoe assembly kit for a microfinishing machine having a base and a pair of jaw arms mounted to said base, at least one of said jaw arms being movable relative to the other jaw arm for engaging a workpiece from opposite directions, the universal shoe assembly kit comprising:

a first shoe assembly comprising:

a first shoe for applying grinding pressure to a surface of a workpiece, and first universal mounting means adapted for mounting said first shoe to one of the jaw arms of the microfinishing machine;

a second shoe assembly comprising:

a second shoe having a grinding surface profile different from that of said first shoe for applying grinding pressure to a surface of a workpiece in a different manner than said first shoe, and second universal mounting means adapted for mounting said second shoe to the same jaw arm of the microfinishing machine to which said first shoe is mounted, said second universal mounting means having the same mounting structure as said first universal mounting means such that said first and second shoes are interchangeably mounted; and securing means for releasably securing one of said first and second mounting means to the jaw arm of the microfinishing machine.

26. The universal shoe assembly kit as defined in claim 25, wherein said second shoe assembly is a taper-correcting shoe.

27. A universal shoe assembly for a microfinishing machine having a base and a pair of jaw arms mounted to said base, at least one of said jaw arms being movable relative to the other jaw arm for engaging a workpiece from opposite directions, the universal shoe assembly comprising:

a shoe for applying grinding pressure to a surface of a workpiece:

universal mounting means adapted for mounting said shoe to one of the jaw arms of the microfinishing machine; and securing means for releasably securing said mounting means to the jaw arm of the microfinishing machine, wherein said shoe is a taper-correcting shoe including a first shoe portion movably mounted to said mounting means for applying variable grinding pressure to a first portion of the surface of the workpiece, and a second shoe portion mounted to said mounting means adjacent said first shoe portion for applying grinding pressure to a second portion of the surface of the workpiece.

28. The universal shoe assembly as defined in claim 27, and further including manual extension means, responsive to manual movement, for extending said first shoe portion outward from the jaw arm on which the shoe assembly is mounted in order to correct any taper of the surface of the workpiece.

29. A method of interchanging shoe assemblies on a jaw arm of a microfinishing machine, the method comprising the steps of:

removing a first shoe assembly from the jaw arm, said first shoe assembly including a first shoe having a grinding surface for applying grinding pressure to a surface of a workpiece, and a first mounting member for releasably securing said first shoe assembly to the jaw arm of the microfinishing machine;

providing a second shoe assembly including a second shoe having a different grinding surface profile than that of said first shoe for applying grinding pressure to the surface of a workpiece in a different manner than said first shoe, and a second mounting member having substantially the same construction as said first mounting member for interchangeably and releasably securing said second shoe assembly to the jaw arm of the microfinishing machine; and securing said second shoe assembly to the jaw arm.

30. The method as defined in claim 29, wherein said second shoe assembly is a taper-correcting shoe.

* * * * *